United States Patent [19]

Staehlin et al.

[11] Patent Number: 4,918,411

[45] Date of Patent: Apr. 17, 1990

[54] DIELECTRIC APERTURE ASSEMBLY AND METHOD FOR FABRICATING THE SAME

[75] Inventors: John H. Staehlin, Lutherville; James A. Bingham, Ellicott City, both of Md.

[73] Assignee: Westinghouse Electric Corp., Pittsburgh, Pa.

[21] Appl. No.: 264,607

[22] Filed: Oct. 31, 1988

[51] Int. Cl.[4] ..... H01P 3/18

[52] U.S. Cl. ..... 333/239; 333/242; 333/248; 343/776; 343/783; 428/131; 428/137; 29/600

[58] Field of Search ..... 333/239, 242, 248; 343/776–778, 785, 841, 911 R, 783; 428/131, 137; 29/600, 601, 846, 852

[56] References Cited

U.S. PATENT DOCUMENTS

| | | | |
|---|---|---|---|
| 3,046,507 | 7/1962 | Jones, Jr. | 333/239 |
| 3,150,336 | 9/1964 | Gonda | 333/243 X |
| 3,522,561 | 8/1970 | Liu | 333/99 R X |
| 3,771,077 | 11/1973 | Tischer | 333/239 |
| 3,877,034 | 4/1975 | Nelson | 343/911 R X |
| 4,419,671 | 12/1983 | Noerpel | 343/786 |
| 4,647,882 | 3/1987 | Landis | 333/239 |

*Primary Examiner*—Eugene R. LaRoche
*Assistant Examiner*—Benny T. Lee
*Attorney, Agent, or Firm*—W. G. Sutcliff

[57] ABSTRACT

A fabricated dielectric aperture assembly includes a first layer of electrically conductive material having an opening therethrough to define a first aperture, a second layer of electrically conductive material spaced from the first electrically conductive layer and having an opening therethrough to define a second aperture and a plurality of solid dielectric layers interposed between the first and second layers of electrically conductive material. The first and second layers of electrically conductive material with the multiple layers of dielectric material interposed therebetween form a generally laminar assembly. A grid-like structure is embedded in the laminar assembly and extends between the first and second electrically conductive layers. The grid-like structure has an inner wall, an outer wall portion, an interior bounded by the inner wall and a plurality of openings extending from the inner wall to the outer wall. The grid-like structure has a body portion embedded in the plurality of layers of solid dielectric material, a first end portion embedded in the first electrically layer in surrounding relation with the first aperture and a second end portion embedded in the second electrically conductive layer in surrounding relation with the second aperture. The grid-like structure defines a waveguide for providing an Rf signal transmission path through the portion of each layer of dielectric material positioned in the interior portion of the waveguide between the first and second apertures.

21 Claims, 2 Drawing Sheets

DIELECTRIC APERTURE ASSEMBLY AND METHOD FOR FABRICATING THE SAME

BACKGROUND OF THE INVENTION

1. Field of the Invention

This invention relates generally to a waveguide device, and more particularly, to a dielectric aperture assembly which includes a grid-like structure defining a waveguide embedded in a plurality of layers of solid dielectric material to provide an RF signal transmission path through the portions of the solid dielectric layers interior to the waveguide. In addition, this invention describes a method for embedding the grid-like structure in the layers of solid dielectric material.

2. Background Information

It is well known that a waveguide constrains or guides the propagation of electromagnetic waves along a path defined by the physical construction of the guide. In a broad sense, devices such as a pair of parallel wires or a coaxial cable can operate as a waveguide. Normally, however, waveguides usually take the form of a metallic tube operable to confine and guide the propagation of electromagnetic waves in the hollow space interior to the tube. As a general rule, the transmission of an electromagnetic wave through the hollow interior of the waveguide is possible if the wavelength of the electromagnetic wave is less than twice the dimensions of the hollow interior.

Although hollow waveguides and coaxial cables are the most common in application, other types of waveguides are also known. For example, a single conductor has been used as a waveguide, and is referred to as a G-string. Another type of waveguide referred to as a microstrip includes a flat conducting strip having a predetermined spacing from a ground plane. A third type of waveguide formed from a dielectric material has been used for the short-distance transmission of VHF waves, and takes the form of a dielectric rod wherein the propagating wave is partly inside and partly outside the dielectric material.

While each waveguide described above does, in fact, provide an electromagnetic wave or RF signal propagation path through the guide, none of these waveguides is directly operable in conjunction with a structure formed from layered sheets of solid dielectric material to provide an RF signal transmission path through the solid dielectric sheets. Specifically, none of the waveguides described above is arranged to be completely embedded in a solid, multi-layered dielectric structure to provide an RF signal transmission path through the solid body of the structure.

It would be desirable to provide a solid, multi-layered dielectric structure having a waveguide embedded therein since it has been found that solid, multiple dielectric structures, in and of themselves, have many useful applications. For example, multi-layered dielectric structures may be used in phased array antenna systems to form the aperture assembly of each phase control module mounted to the antenna face. If this were the case, any RF signal either launched or received by an individual phase control module would be passed through the solid, multi-layered dielectric aperture assembly. However, without some form of RF conduit such as a waveguide embedded in each phase control module multi-layered dielectric aperture assembly, there is a possibility that a portion of the RF signal passed through an individual aperture assembly will become trapped between adjacent dielectric layers. Not only will trapping a portion of an RF, signal between adjacent dielectric layers in a particular aperture assembly cause an incomplete RF signal to be either launched or received by the associated phase control module, the portion of the RF signal trapped between adjacent dielectric layers in a given aperture asembly may produce RF cross-talk with an adjacent aperture assembly in the array.

Therefore, there is a need for an aperture assembly formed from a waveguide embedded in a solid, multi-layered dielectric structure wherein the waveguide provides an essentially lossless RF signal transmission path through the solid dielectric layers. In addition, there is a need for a method for fabricating a dielectric aperture assembly by embedding a waveguide in a structure formed from multiple layers of solid dielectric material.

SUMMARY OF THE INVENTION

In accordance with the present invention, there is provided a fabricated aperture assembly for passing an RF signal therethrough which includes a plurality of layers of solid dielectric material stacked to form a generally laminar structure and having a pair of opposing outer surfaces. A first layer of electrically conductive material having an opening therethrough to define a first aperture is positioned in abutting contact with one of the pair of laminar structure outer surfaces. A second layer of electrically conductive material having an opening therethrough to define a second aperture is positioned in abutting contact with the other laminar structure outer surface, and is positioned so that the second aperture is in substantial alignment with said first aperture. The laminar assembly with the first and second electrically conductive layers positioned thereon forms a generally laminar assembly. A grid-like structure is embedded in the laminar assembly and extends between the first and second electrically conductive layers. The grid-like structure has an inner wall portion, an outer wall portion, a hollow interior portion bounded by the inner wall portion and a plurality of openings extending from the inner wall to the outer wall portions. The grid-like structure has a body portion embedded in the plurality of layers of solid dielectric material, a first end portion embedded in the first electrically conductive layer in surrounding relation with the first aperture and a second end portion embedded in the second electrically conductive layer in surrounding relation with the second aperture. The grid-like structure defines a waveguide for providing an RF signal transmission path through the portion of each layer of solid dielectric material positioned within the interior of the grid-like structure between the first and second apertures.

Further in accordance with the present invention, there is provided a method for fabricating an aperture assembly operable to pass an RF signal therethrough comprising the steps of providing a structure formed from a plurality of layers of solid dielectric material, and positioning a first layer of electrically conductive material in abutting contact with a first exposed surface of the plurality of layers of dielectric material. The first, electrically conductive layer has an opening therethrough to define a first aperture. A second layer of electrically conductive material having an opening therethrough to define a second aperture is positioned in abutting contact with a second exposed surface of the plurality of layers of dielectric material, and is positioned so that the second aperture is in substantial alignment with the first aperture. The method includes the further step of embedding a grid-like structure in the first layer of electrically conductive material, the plurality of layers of dielectric material and the second layer of electrically conductive material to extend between the first and second electrically conductive layers. The grid-like structure has an inner wall portion, an outer wall portion, an interior portion bounded by the inner wall portion and a plurality of openings extending from the inner wall portion to the outer wall portion. The method includes the further step of forming the grid-like structure to include a body portion embedded in the plurality of layers of solid dielectric material and having portions of the layers of dielectric material positioned within the interior portion thereof, a first end portion embedded in the first electrically conductive layer in surrounding relation with the first aperture and a second end portion embedded in the second electrically conductive layer in surrounding relation with the second aperture. The grid-like structure defines an embedded waveguide for providing an RF signal transmission path through the portion of each layer of solid dielectric material positioned within the interior of the waveguide between the first and second apertures.

BRIEF DESCRIPTION OF THE DRAWINGS

The above as well as other features and advantages of the present invention will become apparent through consideration of the detailed description in connection with the accompanying drawings in which.

DESCRIPTION OF THE PREFERRED EMBODIMENTS

Figure 1:
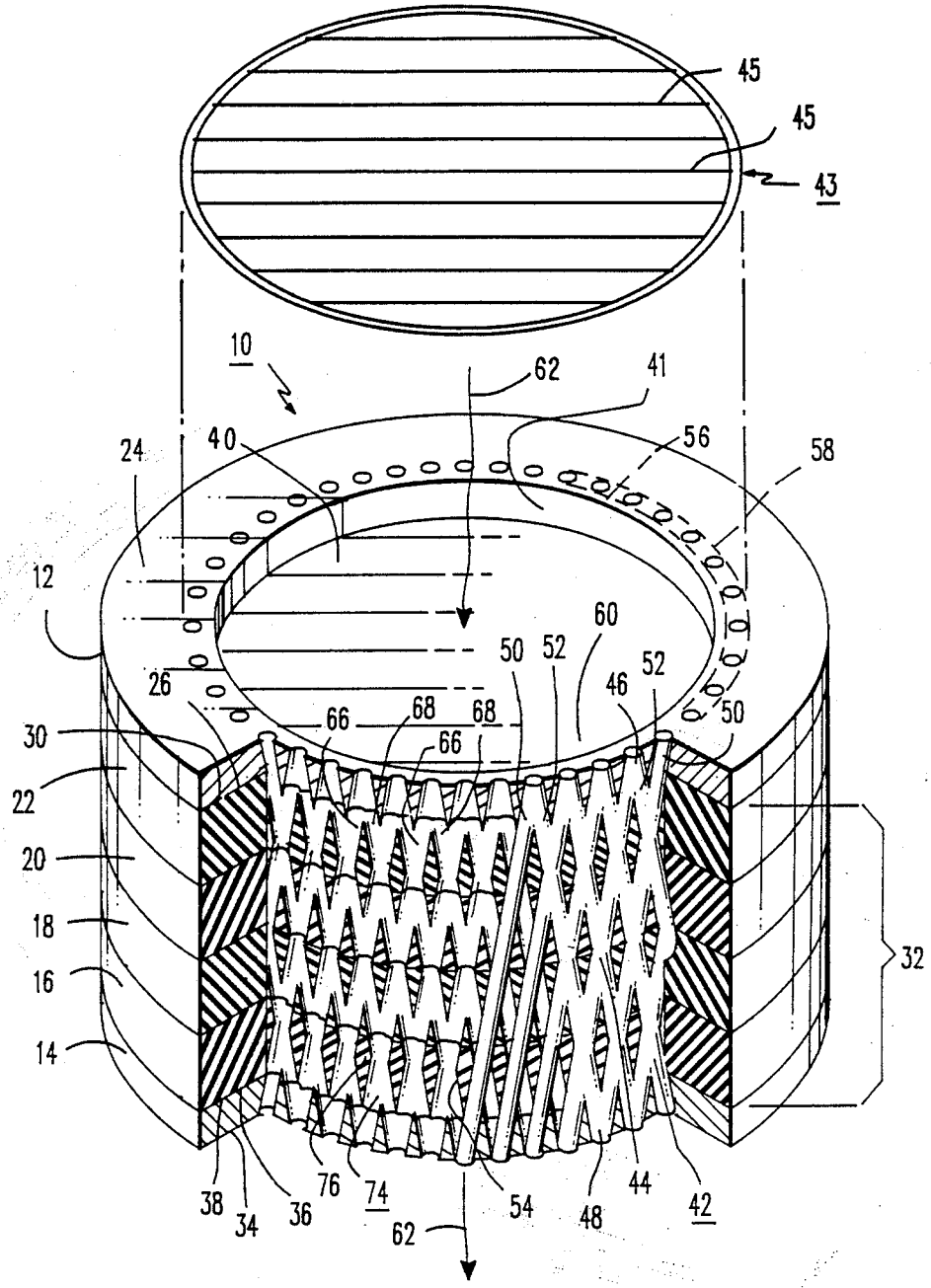
FIG. 1 is a perspective view of one embodiment of the aperture assembly of the present invention, illustrating a fabricated circular waveguide embedded in a plurality of layers of dielectric material.

Referring to the drawings, and particularly to FIG. 1, there is illustrated a solid, multi-layered dielectric aperture assembly generally designated by the numeral 10 which is operable to pass an RF signal therethrough. Aperture assembly 10, which is formed in part from a plurality of discrete layers of solid dielectric material, may be utilized in many radar-based applications, such as the aperture assembly of each transmit/receive module or phase control module in a phased array antenna system.

Aperture assembly 10 is a generally laminar assembly and includes a first layer of electrically conductive material 12, a second layer of electrically conductive material 14, and a plurality of stacked dielectric layers 16, 18, 20, 22 interposed between the first and second electrically conductive layers. Preferably, adjacent dielectric layers are fused to each other to form an essentially bonded structure. It should be understood that although four individual dielectric layers 16–22 are illustrated in FIG. 1, any number of dielectric layers may be interposed between first and second electrically conductive layers 12, 14. It should be further understood that the dielectric layers may have different dielectric constants, if desired.

As seen in FIG. 1, first layer 12 of electrically conductive material has a first surface 24 and a second surface 26 which is substantially parallel with first surface 24. Second surface 26 of first layer 12 is in abutting contact with the exposed or outer surface 30 of the solid dielectric structure 32 formed from the individual dielectric layers 16–22. Similarly, second layer 14 of electrically conductive material has a first surface 34 and a second surface 36 substantially parallel with first surface 34. Second surface 36 is in abutting contact with the exposed or outer surface 38 of dielectric structure 32.

First layer 12 of electrically conductive material has a first opening or aperture 40 therein defining a wall 41 extending between first and second surfaces 24, 26. Although not shown in FIG. 1, second layer 14 of electrically conductive material has a second opening or aperture therein defining a wall extending between first and second surfaces 34, 36. The first and second apertures formed in first and second layers of electrically conductive material 12, 14 are in substantial alignment with each other. That is, the wall 41 defined by first aperture 40 in first electrically conductive layer 12 is in substantial alignment with the wall defined by the second aperture in second electrically conductive layer 14.

As further seen in FIG. 1, aperture assembly 10 includes an embedded grid-like structure 42 (only a portion shown in FIG. 1) which extends between first electrically conductive layer 12, first surface 24, and second electrically conductive layer 14, first surface 34. Specifically, grid-like structure 42 includes a body portion 44 embedded in dielectric structure 32 formed from the plurality of solid dielectric layers 16–22, a first end portion 46 embedded in first electrically conductive layer 12 and terminating at first surface 24, and a second end portion 48 embedded in second electrically conductive layer 14 and terminating at first surface 34. The first and second end portions 46, 48 are integral with and extend from opposite ends of body portion 44. As will be explained later in greater detail, grid-like structure 42 is formed from an electrically conductive material and electrically connects first and second electrically conductive layers 12, 14. The first end portion 46, body portion 44, and second end portion 48 of grid-like structure 42 form a generally cylindrical wall with a circular cross-section embedded in aperture assembly 10. The generally cylindrical configuration of grid-like structure 42 permits the first and second end portions 46, 48 to surround circular first aperture 40 in first electrically conductive layer 12 and the aligned circular aperture (not shown) in second electrically conductive layer 14, respectively. Preferably, the first and second end portions 46, 48 surround the first and second apertures, respectively, with the inside wall of each end portion in either a closely adjacent or contacting relation with the walls defined by the apertures.

As seen in FIG. 1, the generally cylindrical grid-like structure 42 includes a first set of parallel electrical conductors 50 and a second set of parallel electrical conductors 52. One conductor 50 in the first set of parallel electrical conductors is angularly spaced from and intersects at least one conductor 52 in the second set of parallel electrical conductors. In addition, a pair of adjacent conductors 50 in the first set of parallel electrical conductors and a pair of adjacent conductors 52 in the second set of parallel electrical conductors are spaced apart by a preselected distance to provide that any two adjacent electrical conductors 50 in the first set of conductors intersecting any two adjacent conductors 52 in the second set of conductors forms a parallelogram-shaped opening 54. Each parallelogram-shaped opening 54 in grid-like structure 42 extends completely through the wall of the structure from inner wall portion 56 to outer wall portion 58 (portions of the inner and outer wall portions 56, 58 schematically represented by dotted lines in FIG. 1).

The grid-like structure 42 embedded in dielectric structure 32 and first and second layers of electrically conductive material 12, 14 has a hollow interior 60 bounded by inner wall portion 56. The hollow interior 60 of grid-like structure 42 is filled with portions of layers of dielectric material corresponding to portions of the solid dielectric layers 16–22. In addition, since grid-like structure 42 illustrated in FIG. 1 has a generally circular cross-sectional configuration of uniform diameter between first layer 12, first surface 24, and second layer 14, first surface 34, the hollow interior 60 of grid-like structure 42 bounded by inner wall portion 56 is generally cylindrical in configuration.

As described, the grid-like structure 42 embedded in dielectric structure 32 and first and second electrically conductive layers 12, 14 defines a grid-like waveguide extending between first electrically conductive layer 12, first surface 24, and second electrically conductive layer 14, first surface 34. The grid-like structure 42 defining the waveguide provides an RF signal transmission path for an RF signal schematically illustrated and designated by the numeral 62 from first aperture 40 through the portions of the solid dielectric layers 16–22 positioned within the hollow interior 60 of grid-like structure 42 to the aligned second aperture in second electrically conductive layer 14. Embedding grid-like structure 42 in the plurality of solid dielectric layers 16–22 and utilizing the grid-like structure as a waveguide for providing an RF signal transmission path through the interior portion thereof eliminates problems normally associated with passing an RF signal through solid dielectric layers such as trapping a portion of the RF signal between adjacent dielectric layers. The multiple layers of solid dielectric material having a grid-like waveguide embedded therein form a multi-layered dielectric aperture assembly that provides an essentially lossless RF signal transmission path therethrough. It should be understood that, in order for grid-like structure 42 to effectively operate as a waveguide, the perimeter of each of the parallelogram-shaped openings 54 extending between inner wall portion 56 and outer wall portion 58 should have an overall length less than one-half the wavelength of the RF signal 62 passed through the waveguide.

If desired, a polarization suppression grid schematically illustrated and designated by the numeral 43 may be positioned at the input aperture of aperture assembly 10 (aperture 40 in FIG. 1) to block one polarization of RF signal 62 passed through the grid-like waveguide 42 extending between the aligned first and second, apertures. If utilized, suppression grid 43 includes a plurality of parallel wires 45 spaced from each other by a preselected distance and positioned to span the opening defining the input aperture.

Figure 1A:
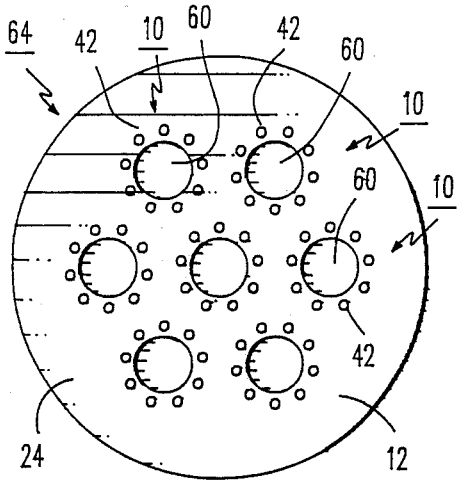
FIG. 1A is a top plan view of an array of circular aperture assemblies embedded in a plurality of layers of dielectric material.

Now referring to FIG. 1A, there is illustrated a top view of a plurality or array of circular aperture assemblies each similar to the aperture assembly 10 previously described formed in a generally laminar assembly 64. Although not illustrated in FIG. 1A, laminar assembly 64 includes a plurality of layers of solid dielectric material forming a dielectric structure similar to dielectric structure 32 of FIG. 1 interposed between first and second layers of electrically conductive material (only first electrically conductive layer 12 is shown in FIG. 1A).

As previously described with reference to FIG. 1, cylindrical grid-like structure 42 defining a waveguide provides an essentially lossless RF signal transmission path through the portions of the solid dielectric layers interior to each aperture assembly 10 (illustrated at 60), and prevents a portion of the RF signal passed through the plurality of dielectric layers from becoming trapped between adjacent dielectric layers. Since a complete RF signal is passed through the grid-like waveguide 42 of each aperture assembly 10, it can be seen in FIG. 1A that an array of aperture assemblies 10 may be formed in a single dielectric structure and in close proximity to each other without incurring RF signal cross talk between adjacent aperture assemblies. This permits the array of aperture assemblies to be formed in one multi-layered dielectric structure wherein adjacent assemblies in close proximity to each other are effectively electrically isolated from each other.

Again referring to FIG. 1, the multi-layered dielectric aperture assembly 10 illustrated therein is fabricated by first providing individual, solid dielectric layers 16, 18, 20 and 22, stacking the individual dielectric layers to form dielectric structure 32 and preferably fusing or bonding by suitable means the individual layers together to form a bonded dielectric section. The first and second layers of electrically conductive material 12, 14 are deposited on the exposed or outer surfaces 30, 38 of dielectric structure 32. The deposition of first and second electrically conductive layers 12, 14 on the outer or exposed surfaces 30, 38 may be accomplished using any known metal deposition or electroplating process.

After the addition of first and second electrically conductive layers 12, 14 to the dielectric structure 32, a first set of parallel bores 66 and a second set of parallel bores 68 are drilled completely through first electrically conductive layer 12, dielectric structure 32 and second electrically conductive layer 14. It is preferred that each of the bores 66, 68 in the first and second set of parallel bores be formed via a laser drilling process; however, any equivalent bore-forming process may be utilized if desired. As seen in FIG. 1, each individual bore 66 in the first set of parallel bores is angularly spaced from and intersects at least one bore 68 in the second set of parallel bores to form a grid-like network of bores generally designated by the numeral 74 extending through first electrically conductive layer 12, dielectric structure 32 and second electrically conductive layer 14. In addition, a pair of adjacent bores 66 in the first set of parallel bores and a pair of adjacent bores 68 in the second set of parallel bores are spaced apart by a preselected distance to provide that any two adjacent bores 66 in the first set of parallel bores intersecting any two adjacent bores 68 in the second set of parallel bores leaves a portion of dielectric material 76 having a parallelogram-shaped configuration.

The laser drilling process provides a generally cylindrical grid-like network of bores (only a portion of the drilled bores shown in FIG. 1) which terminate at the first surfaces 24, 34 of first and second electrically conductive layers 12, 14, respectively. After the grid-like network of bores 74 are formed, each of the bores is plated through or filled with an electrically conductive material to form grid-like structure 42 having a plurality of parallelogram-shaped openings 54 therein defining the waveguide described herein. Since the grid-like network of bores extends between first and second electrically conductive layers 12, 14, and each of the bores is plated through or filled with an electrically conductive material to form the grid-like waveguide 42, it is seen in FIG. 1 that waveguide 42 electrically connects first and second electrically conductive layers, 12, 14.

After grid-like structure 42 is formed via any suitable bore plating or filling process, the first and second apertures are formed in first and second electrically conductive layers 12, 14, respectively. Any known metal etching process may be utilized to form the aligned apertures, and it is preferred that the walls defining the apertures in first and second electrically conductive layers 12, 14 lie in closely adjacent or contacting relation with the inside wall portion 56 of waveguide 42. If it is desired to form a polarization suppression grid at one of the apertures, an etching process is utilized to form a plurality of spaced-apart wires or conductors extending across the selected aperture opening.

Figure 2A:
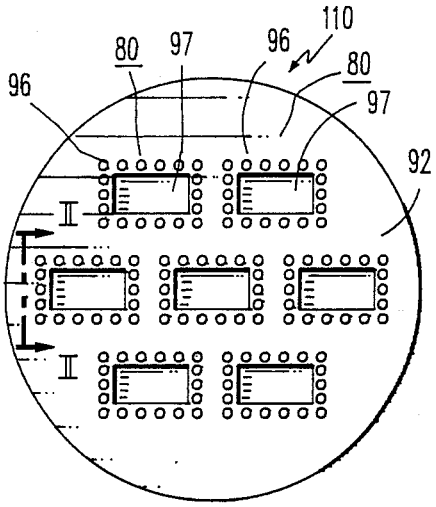
FIG. 2A is a top plan view of an array of rectangular aperture assemblies embedded in a plurality of layers of dielectric material.
Figure 2:
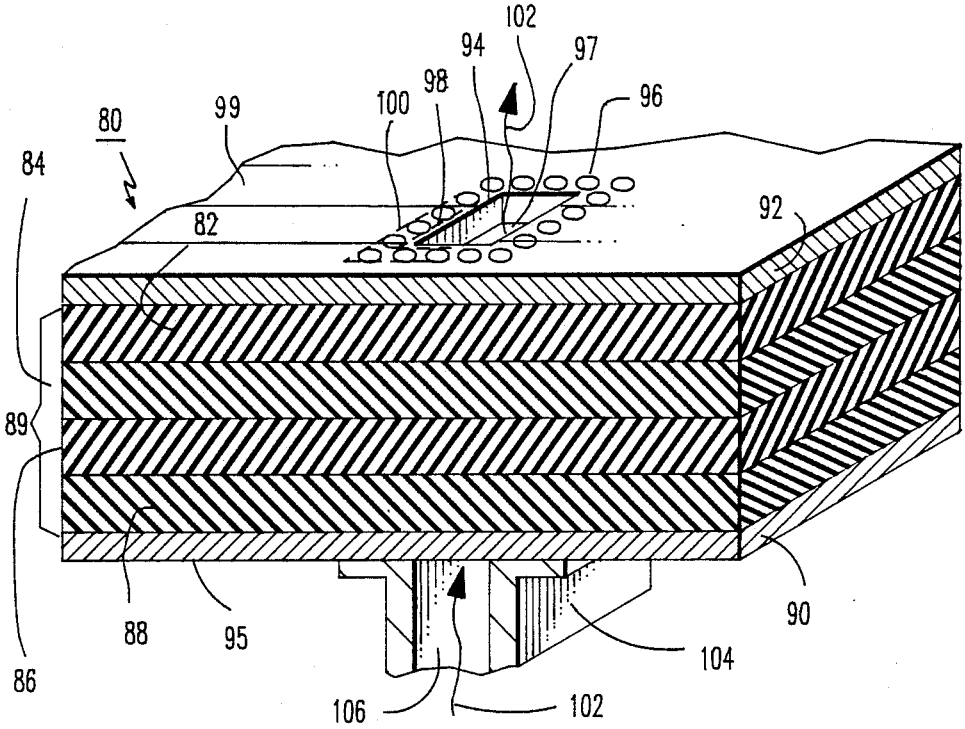
FIG. 2 is a perspective view of an alternate embodiment of the aperture assembly of the present invention, illustrating a fabricated rectangular waveguide embedded in a plurality of layers of dielectric material.

Now referring to FIG. 2, there is illustrated a multi-layered dielectric aperture assembly 80 similar to the aperture assembly 10 of FIG. 1 with the exception that aperture assembly 80 has a generally rectangular cross-sectional configuration. Aperture assembly 80 includes a laminar arrangement of dielectric layers 82, 84, 86 and 88 interposed between first and second layers 90, 92 of electrically conductive material. The first and second layers of electrically conductive material 90, 92 are etched to form a pair of aligned, generally rectangular apertures (only aperture 94 in second electrically conductive layer 92 shown in FIG. 2). A grid-like structure 96 is embedded in the plurality of dielectric layers 82–88 forming dielectric structure 89 and first and second electrically conductive layers 90, 92 to extend between the outer surfaces 95, 99 of first and second electrically conductive layers 90, 92. Although the specific configuration of grid-like structure 96 is not illustrated in FIG. 2, it should be apparent that grid-like structure 96 has a generally rectangular cross-sectional configuration and includes first and second sets of parallel electrical conductors formed utilizing the same laser drilling and bore plating or filling processes described with reference to the circular cross-sectional grid-like structure 42 of FIG. 1. The rectangular cross-sectional, grid-like structure 96 has an inner wall portion 98 and an outer wall portion 100 (inner and outer wall portions 98, 100 represented schematically by the dotted lines in FIG. 2), with a plurality of parallelogram-shaped openings extending therebetween.

An RF signal schematically illustrated by the numeral 102 may be passed through a waveguide 104 connected by suitable means to first layer 90 of electrically conductive material. The waveguide 104 has a hollow interior portion 106 which is preferably aligned with the aperture formed in first electrically conductive layer 90. As previously described for the cylindrical waveguide of FIG. 1, each of the parallelogram-shaped openings in the wall of rectangular waveguide 96 (not shown) has a perimeter whose overall length is less than one-half the wavelength of RF signal 102. As a result, RF signal 102 will pass through the portions of the solid dielectric layers 82–88 interior to the rectangular waveguide 96 (illustrated at 97) embedded in first and second electrically conductive layers 90, 92 and the plurality of dielectric layers 82–88, without a portion of the RF signal escaping the waveguide and being trapped between adjacent dielectric layers.

Now referring to FIG. 2A, there is illustrated a top view of a plurality or array of aperture assemblies each similar to the aperture assembly 80 previously described formed in a generally laminar assembly 110. Although not illustrated in FIG. 2A, laminar structure 110 includes a plurality of layers of solid dielectric material forming a dielectric structure similar to dielectric structure 89 of FIG. 2 interposed between first and second layers of electrically conductive material (only second layer 92 shown).

As previously described with reference to FIG. 2, rectangular cross-sectional grid-like structure 96 defining a waveguide provides an RF signal transmission path through the portions of the solid dielectric layers interior to each aperture assembly 80 (illustrated at 97), and prevents a portion of the RF signal passed through the plurality of dielectric layers from being trapped between adjacent dielectric layers. Since a compete RF signal is passed through the grid-like waveguide 96 of each aperture assembly 80 in laminar structure 110, it can be seen from FIG. 2A that an array of aperture assemblies 80 may be formed in a single dielectric structure and in close proximity to each other without incurring RF signal cross talk between adjacent aperture assemblies. This permits the array of aperture assemblies to be formed in one multi-layered dielectric structure wherein adjacent assemblies in close proximity to each other are effectively electrically isolated from each other.

What has been described herein is a multi-layered dielectric aperture assembly formed from a plurality of individual layers of solid dielectric material interposed between layers of electrically conductive material. Each dielectric layer may have a different dielectric constant if desired. Aligned apertures are formed in the electrically conductive layers, and a grid-like structure defining a waveguide is embedded in the electrically conductive layers and dielectric layers to extend between and surround the aligned apertures. As a result of the drilling and plating processes utilized to form the embedded waveguide, the wall of the waveguide has a plurality of openings therein. The perimeter of each opening in the waveguide wall has an overall length less than one-half the wavelength of an RF signal passed through the waveguide to prevent a portion of the RF signal passed through the portions of the layers of said dielectric material interior to the waveguide from escaping the waveguide and becoming trapped between adjacent layers of dielectric material.

Although the present invention has been described in terms of what are at present believed to be its preferred embodiments, it will be apparent to those skilled in the art that various changes may be made without departing from the scope of the invention. It is therefore intended that the appended claims cover such changes.

We claim:

1. A fabricated dielectric aperture assembly for passing an RF signal therethrough, comprising:

a plurality of layers of solid dielectric material stacked to form a generally laminar structure, said laminar structure having a pair of opposing outer surfaces;

a first layer of electrically conductive material having an opening therethrough to define a first aperture, said first layer of electrically conductive material positioned in abutting contact with one of said pair of laminar structure outer surfaces;

a second layer of electrically conductive material having an opening therethrough to define a second aperture, said second layer of electrically conductive material positioned in abutting contact with the other of said pair of laminar structure outer surfaces and positioned so that said second aperture is in substantial alignment with said first aperture;

said laminar structure and said first and second layers of electrically conductive material forming a generally laminar assembly;

a grid-like structure having a body portion and first and second end portions integral with and respectively extending from opposite ends of said body portion, said grid-like structure having a configuration to define an inner wall, an outer wall, a plurality of openings extending from said inner wall to said outer wall and an interior portion bounded by said inner wall;

said grid-like structure body portion being embedded in said plurality of solid layers of dielectric material forming said laminar structure so that at least a portion of each said layer of solid dielectric material is positioned within said interior portion;

said first and second end portions of said grid-like structure being embedded in said first and second electrically conductive layers, respectively, in surrounding relation with said first and second apertures; and said grid-like structure in combination with said plurality of layers of dielectric material and said first and second layers of electrically conductive material defining a waveguide for providing an RF signal transmission path through said portion of each said layer of solid dielectric material positioned within said interior portion of said grid-like structure between said first and second apertures.

2. The fabricated dielectric aperture assembly of claim 1, in which:

each of said plurality of openings in said grid-like structure defines a perimeter whose overall length is less than one-half the wavelength of an RF signal passed through said portion of each said layer of solid dielectric material interior to said grid-like structure.

3. The fabricated dielectric aperture assembly of claim 1, in which:

said first and second layers of electrically conductive material with said plurality of layers of solid dielectric material interposed therebetween have a first set of spaced-apart, parallel bores and a second set of spaced apart, parallel bores extending completely therethrough, one bore of said first set of bores being angularly spaced from and intersecting at least one bore of said second set of bores to form a grid-like network of bores through said first electrically conductive layer, said plurality of solid dielectric layers and second, electrically conductive layer;

said grid-like network of bores being plated through with an electrically conductive material such as to form said grid-like structure having said plurality of openings extending from said inner wall to said outer wall; and adjacent bores of said first parallel set of bores and adjacent bores of said second parallel set of bores being spaced apart by a preselected distance to provide that any two adjacent bores of said first set of bores intersecting any two adjacent bores of said second set of bores forms a parallelogram-shaped opening upon plating.

4. The fabricated dielectric aperture assembly of claim 1, in which:

said first and second apertures are located in said first and second electrically conductive layers, respectively, for alignment with at least a portion of each said layer of solid dielectric material interior to said grid-like structure defining said waveguide.

5. The fabricated dielectric aperture assembly of claim 1, in which:

said first layer of electrically conductive material has a first surface and a second surface substantially parallel therewith, said first aperture extending between said first and second surfaces to define a first wall;

said second layer of electrically conductive material has a first surface and a second surface substantially parallel therewith, said second aperture extending between said first and second surfaces to define a second wall; and said first and second end portions of said grid-like structure each having a configuration to surround said first and second walls, respectively.

6. The fabricated dielectric aperture assembly of claim 5, in which:

said first and second end portions of said grid-like structure each have a configuration to surround said first and second walls, respectively, in contacting relation therewith.

7. The fabricated dielectric aperture assembly of claim 5, in which:

said first and second walls each have a circular configuration; and said grid-like structure first and second end portions each have a circular configuration to surround said first and second walls, respectively.

8. The fabricated dielectric aperture assembly of claim 5, in which:

said first and second walls each have a rectangular configuration; and said grid-like structure first and second end portions each have a rectangular configuration to surround said first and second walls, respectively.

9. The fabricated dielectric aperture assembly of claim 1, in which:

said grid-like structure extending between said first and second layers of electrically conductive material is made from an electrically conductive material to electrically connect said first and second layers.

10. The fabricated dielectric aperture assembly of claim 1, in which:

said plurality of layers of solid dielectric material are bonded together to form a bonded, multimaterial layered dielectric structure.

11. The fabricated dielectric aperture assembly of claim 1, in which:

said inner and outer wall portions of said grid-like structure each have a substantially uniform cross section.

12. The fabricated dielectric aperture assembly of claim 1, which includes:

a polarization suppression grid at one of said apertures to block one polarization of an RF signal passed through said grid-like structure, said suppression grid including a plurality of parallel wires spaced a preselected distance apart and spanning the opening defining said aperture.

13. A method for forming a dielectric aperture assembly operable to pass an RF signal therethrough comprising the steps of:

providing a plurality of layers of solid dielectric material arranged to form a generally laminar structure;

positioning a first layer of electrically conductive material in abutting contact with a first exposed surface of said plurality of layers of dielectric material, said first layer having an opening therethrough to define a first aperture;

positioning a second layer of electrically conductive material having an opening therethrough to define a second aperture in abutting contact with a second exposed surface of said plurality of layers of dielectric material so that said second aperture is in substantial alignment with said first aperture;

embedding a grid-like structure in said first layer of electrically conductive material, said plurality of layers of said dielectric material forming said laminar structure and said second layer of electrically conductive material to extend between said first and second electrically conductive layers, said grid-like structure having an inner wall portion, an outer wall portion, an interior portion bounded by said inner wall portion and a plurality of openings extending from said inner wall portion to said outer wall portion; and forming said grid-like structure to include a body portion embedded in said plurality of solid layers of dielectric material, a first end portion embedded in said first electrically conductive layer in surrounding relation with said first aperture and a second end portion embedded in said second electrically conductive layer in surrounding relation with said second aperture to define an embedded waveguide for providing an RF signal transmission path through portions of said layers of said dielectric material positioned within said interior portion of said grid-like structure between said first and second apertures.

14. The method of claim 13, including:

selecting the perimeter of each opening in said grid-like structure to provide that said perimeter is of an overall length less than one-half the wavelength of an RF signal passed through said portions of said layers of solid dielectric material positioned within said interior portion of said grid-like structure.

15. The method of claim 13, including the steps of:

extending a first set of spaced apart, parallel bores and a second set of spaced apart, parallel bores completely through said first layer of electrically conductive material, said plurality of layers of dielectric material and said second layer of electrically conductive material with one bore of said first parallel set of bores angularly spaced from and intersecting at least one bore of said second parallel set of bores to form a grid-like network of bores;

plating said grid-like network of bores with an electrically conductive material so as to form said grid-like structure; and spacing adjacent bores of said first parallel set of bores and adjacent bores of said second parallel set of bores a preselected distance apart to provide that any two adjacent bores of said first set of bores intersecting any two adjacent bores of said second set of bores forms a parallelogram-shaped opening upon plating.

16. The method of claim 13, including:

positioning said first and second apertures in said first and second electrically conductive layers, respectively, for alignment with at least a portion of each said layer of dielectric material positioned within said interior portion of said grid-like structure defining said waveguide.

17. The method of claim 13, including:

forming circular openings in said first and second electrically conductive layers to respectively define first and second circular apertures therein; and forming each of said grid-like structure first and second end portions in a circular cross-sectional configuration to surround said first and second circular apertures, respectively.

18. The method of claim 13, including:

forming rectangular openings in said first and second electrically conductive layers to respectively define first and second rectangular apertures therein; and forming each of said grid-like structure first and second end portions in a rectangular cross-sectional configuration to surround said first and second rectangular apertures, respectively.

19. The method of claim 13, including:

forming a polarization suppression grid at one of said apertures to block one polarization of an RF signal passed through said grid-like structure defining said waveguide, said suppression grid including a plurality of parallel wires spaced apart a preselected distance and spanning said one of said openings defining said aperture.

20. An array of individual dielectric aperture assemblies formed in a plurality of layers of solid dielectric material stacked to form a generally laminar structure, each dielectric aperture assembly in the array being operable to pass an RF signal therethrough, comprising:

a plurality of layers of solid dielectric material stacked to form a generally laminar structure, said laminar structure having a pair of opposing outer surfaces;

a first layer of electrically conductive material having a plurality of openings therethrough to define a plurality of first apertures, said first layer of electrically conductive material in abutting contact with one of said pair of laminar structure outer surfaces;

a second layer of electrically conductive material having a plurality of second openings therethrough to define a plurality of second apertures, said second layer of electrically conductive material in abutting contact with the other of said pair of laminar structure outer surfaces and positioned to provide that each of said second apertures in said second layer is in substantial alignment with a corresponding one of said first apertures in said first layer;

said laminar structure and said first and second layers of electrically conductive material forming a generally laminar assembly;

a plurality of grid-like structures each having a body portion and first and second end portions integral with and respectively extending from opposite ends of said body portion; each said grid-like structure having a configuration to define an inner wall, an outer wall, a plurality of openings extending from said inner to said outer walls and an interior portion bounded by said inner wall;

said plurality of grid-like structures being embedded in said generally laminar assembly at preselected locations to provide an array of individual grid-like structures in said laminar assembly;

said body portion of each said grid-like structure being embedded in said plurality of layers of solid dielectric material forming said laminar structure so that at least a portion of each said layer of solid dielectric material is positioned within said interior portion of each said grid-like structure;

said first and second end portions of each said grid-like structure being embedded in said first and second electrically conductive layers, respectively, in surrounding relation with an aligned pair of first and second apertures; and said array of grid-like structures in combination with said plurality of layers of dielectric material and said first and second layers of electrically conductive material defining an array of individual waveguides, an individual waveguide providing a discrete RF signal transmission path through said portion of each said layer of solid dielectric material positioned within said interior portion of said grid-like structure between a respective aligned pair of first and second apertures surrounded by said grid-like structure first and second end portions.

21. The array of claim 20, in which:

each of said plurality of openings in each of said grid-like structures defines a perimeter whose overall length is less than one-half the wavelength of an RF signal passed through said portions of said layers of solid dielectric material positioned within said interior portion of each of said grid-like structures.

* * * * *